United States Patent [19]

Snellgrove

[11] Patent Number: 4,989,651

[45] Date of Patent: Feb. 5, 1991

[54] AUTOMATIC VENEER LATHE TRASH GATE

[75] Inventor: Edward L. Snellgrove, Tacoma, Wash.

[73] Assignee: Weyerhaeuser Company, Tacoma, Wash.

[21] Appl. No.: 298,556

[22] Filed: Jan. 17, 1989

[51] Int. Cl.[5] ..... B27C 9/00; B27B 1/00; B27M 1/08

[52] U.S. Cl. ..... 144/3 R; 83/106; 83/365; 83/367; 83/371; 118/37; 118/42; 156/64; 156/379; 144/209 R; 144/356; 144/365; 144/367

[58] Field of Search ..... 118/37, 40, 42, 668; 83/105, 106, 107, 365, 367, 370, 371; 156/64, 378, 379; 144/3 R, 2 R, 3 N, 356, 209 R, 365, 367

[56] References Cited

U.S. PATENT DOCUMENTS

| | | | |
|---|---|---|---|
| 3,093,021 | 6/1963 | Walsh | 83/106 |
| 3,169,428 | 2/1965 | Owen | 83/27 |
| 3,199,555 | 8/1965 | Hildebrand | 144/3 R |
| 3,264,917 | 8/1966 | Califano et al. | 83/94 |
| 3,566,937 | 3/1971 | Erickson | 144/3 R |
| 3,591,279 | 7/1969 | Gardner et al. | 355/29 |
| 3,866,498 | 2/1975 | Jarman | 83/89 |
| 4,726,271 | 2/1988 | McEwan | 144/356 |
| 4,809,754 | 3/1989 | Barnes | 144/367 |

FOREIGN PATENT DOCUMENTS

| | | | |
|---|---|---|---|
| 925140 | 8/1947 | France | 144/209 R |

*Primary Examiner*—W. Donald Bray
*Attorney, Agent, or Firm*—Graybeal, Jensen & Puntigam

[57] ABSTRACT

The system includes a veneer lathe, a conveyor or apron (50) onto which the veneer from the lathe is initially directed, followed by a combination of an anvil roller (54) and a rotating clipper knife (62), which in turn is followed by a trash gate (72). The speed and rotation of the knife (62) is controlled such that the veneer material produced by operation of the lathe is first cut upon recognition of the start of random veneer and then again upon the recognition of the start of ribbon veneer. The trash gate (72) is controlled synchronously with the operation of the knife (62) such that the trash gate (72) is open up to the point in time where the veneer trash is cut from the remainder of the veneer material, at which point the trash gate (72) is closed.

13 Claims, 7 Drawing Sheets

AUTOMATIC VENEER LATHE TRASH GATE

DESCRIPTION

1. Technical Field

This invention relates generally to the art of veneer-making and more specifically concerns a veneer clipper/trash gate arrangement which is part of a complete veneer-making system and is located downstream of the veneer lathe which is also part of a complete veneer system.

2. Background Art

A typical veneer-making system of the prior art is shown in FIG. 1. The system includes a conventional veneer lathe 10 which in turn includes a lathe knife 12 which "peels" a rotating log to produce veneer. The veneer produced by the operation of the lathe 10 is moved downstream by a moving apron 14. In operation, as veneer is formed from the log, referred to generally as a block (not shown), it is sensed by a scanner (not shown), which is typically positioned above the apron 14.

The material initially produced by the operation of the lathe is not suitable for commercial veneer, and is generally referred to as roundup or trash. During this initial portion of the veneer peeling process, the trash gate 18 is open so that the veneer trash falls beneath the trash gate to a conveyor (not shown). The veneer trash is typically applied to a chipper, for use in the manufacture of other selected wood products. The start of usable veneer is sensed by the scanner after it separates from the log and is moved away by the apron 14. At this point in the operation of the prior art system, the lathe is stopped and the lathe knife 12 cuts completely through the material just peeled, separating the veneer trash from the upstream usable veneer. The trash gate 18 is then closed and the lathe is restarted. For a period of time after restart of the lathe, the usable veneer portions of the veneer material are of different sizes and the veneer is generally referred to as random veneer.

The sheets of random veneer are directed to a first tray, typically the lowest one. Random veneer continues for a short while, until "full length" veneer (101–106 inches) is produced, which is generally referred to as ribbon veneer. Sheet breaker 17 clips, i.e. cuts, the veneer sheet at that point, separating the random veneer from the following ribbon veneer. Ribbon veneer is directed to another tray in the tray system and continues until the veneer block is exhausted or if the tray is to be changed, at which point the veneer is again clipped.

A significant disadvantage of the above-described prior art system is that the veneer lathe must be stopped during separation of the roundup (trash) from usable veneer. After restart of the lathe, approximately 2 ½ wraps are required in order to get the resulting veneer up to the required thickness again. This results in loss of production time of approximately 7%. The 2 ½ wraps are unusable as veneer, so there is a loss of product as well, approximately 4% in a typical embodiment. Hence there is a relatively significant loss of time and product with the prior art system. The thrust of new development in the art has been to reduce the above-described losses by careful control of the operation of the veneer knife, i.e. by attempting to begin veneer peeling upon restart at the point on the block where peeling was stopped when the lathe was stopped.

DISCLOSURE OF THE INVENTION

The system of the present invention includes a lathe for peeling veneer from a log, which initially results in the production of unusable or trash veneer, means for recognizing the start of usable veneer, as opposed to the preceding trash veneer, means for separating, such as by cutting, the initial trash veneer from the upstream usable veneer, and a trash gate which has an open position and a closed position. When the trash gate is open, veneer trash is directed below the trash gate to a trash receiver, such as a conveyor. The trash gate is closed at approximately the time that the trash veneer is separated from the upstream usable veneer such that the usable veneer moves over the closed trash gate to a veneer tray for further processing. The trash gate is positioned relative to the separating means and is operated relative to the operation of the separating means such that the lathe can peel a given log without stopping.

FIGS. *6a–6c* are diagrams showing a sequence of steps in the manufacture of veneer.

BEST MODE FOR CARRYING OUT THE INVENTION

Figure 1:
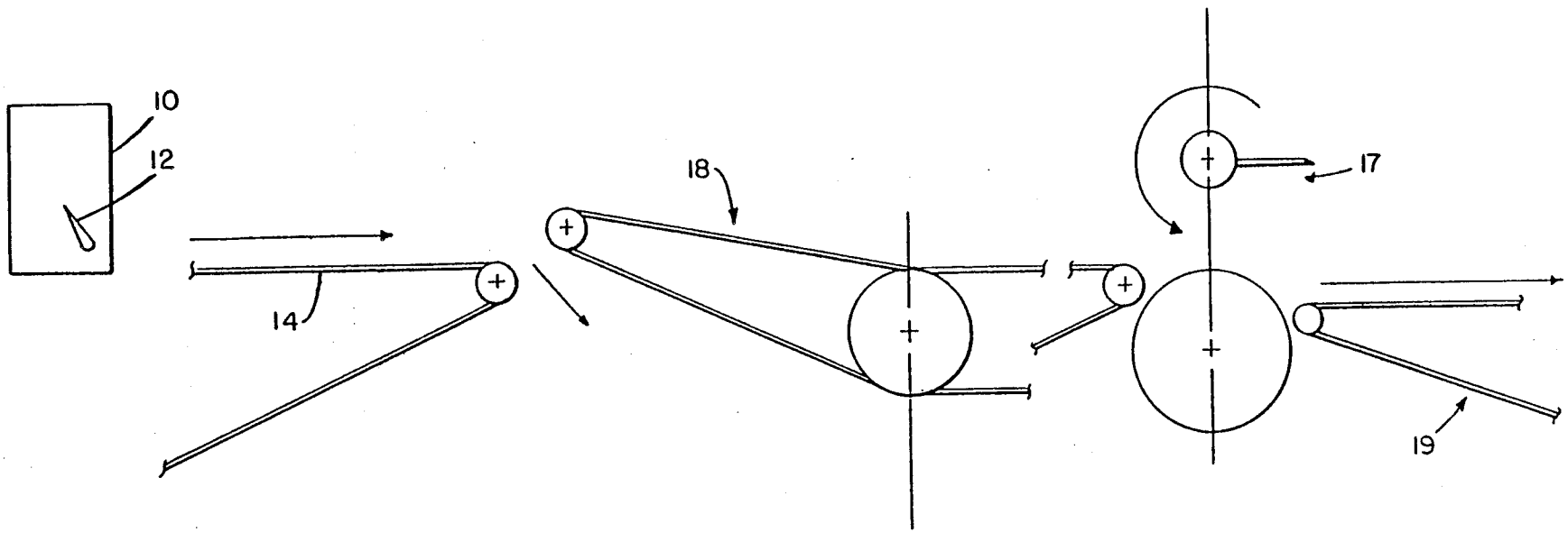
FIG. 1 PRIOR ART
FIG. 1 is a block diagram showing the veneer system of the prior art.
Figure 2:
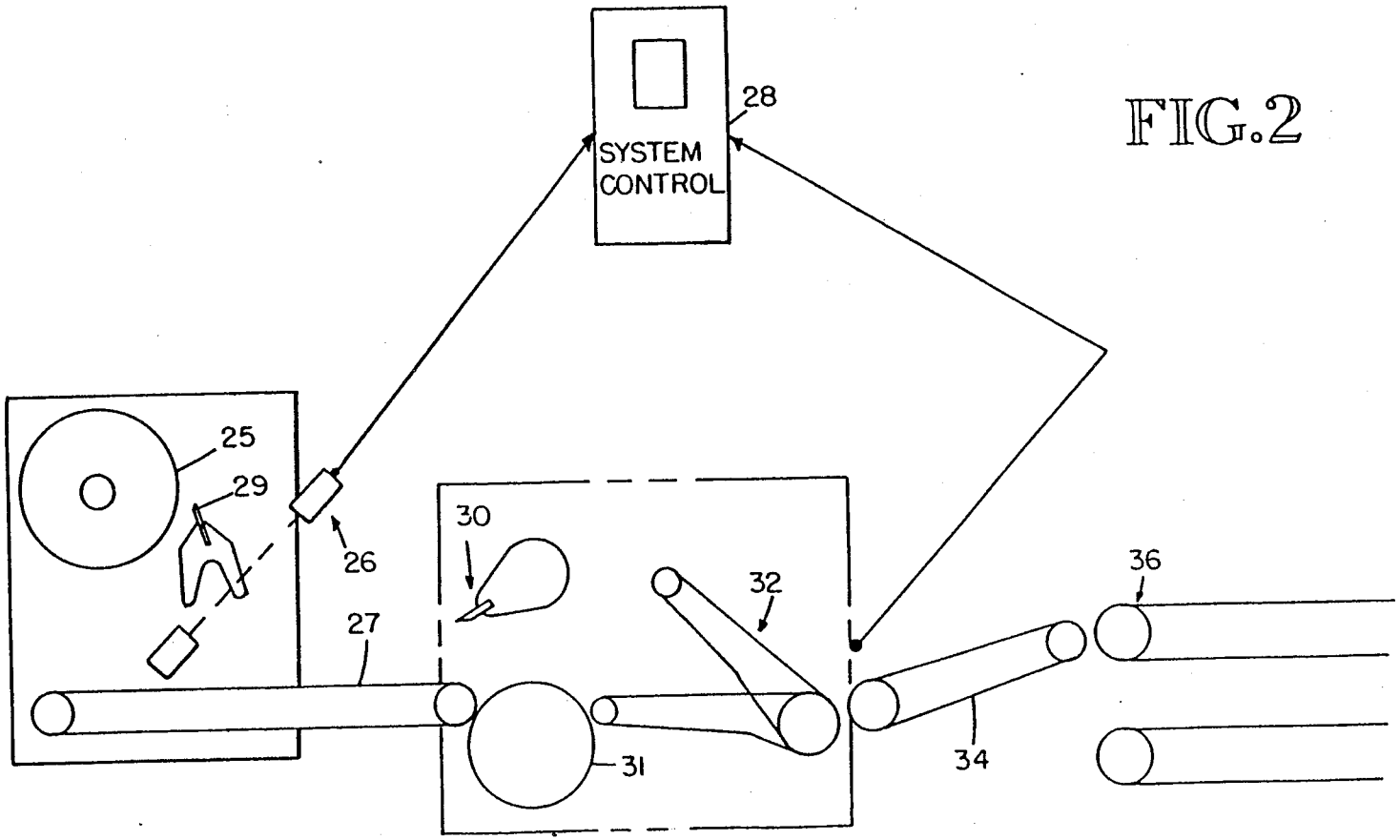
FIG. 2 is a block diagram of the veneer system of the present invention.

FIG. 2 shows a basic block diagram of the veneer system of the present invention, which is downstream of the veneer lathe. The apron scanner 26 scans the veneer material following its removal, i.e. peel, from a block 25 by a knife 29, as it moves downstream on a moving apron 27. The scanner 26 is connected to a system control unit 28 which controls the operation of a clipper knife 30 and a trash gate 32 which is located downstream of the clipper knife. The two operating positions of the trash gate are shown in FIG. 2. Under the control of apron scanner 16 and the control unit 28, the trash gate 32 remains open, i.e. in a raised position, until the beginning of random veneer from the veneer lathe is sensed, at which point the clipper knife 30 separates (cuts) the trash veneer material from the following random veneer, as it passes over an anvil roller 31. As described above, random veneer is usable veneer in the form of odd sizes, the sizes depending on the gaps in the veneer material as it is peeled from the block. The trash gate 32 closes at the same time that the trash veneer is clipped. The follow-on random veneer then moves over tipple 34 to one of the veneer trays shown generally as tray system 36. Typically, random veneer is directed to the lowermost tray.

When control unit 28 senses the beginning of ribbon veneer, such that a tray change is required, another cut by the clipper knife 30 is made. The ribbon veneer is then continuously directed to another selected tray in the tray system 36. Thereafter, the clipper knife will operate only when a tray change is made. With the particular arrangement of FIG. 2, including the location of the trash gate 32 relative to the clipper knife 30 and the use of the apron scanner 26 and the control unit 28, it is unnecessary to stop the operation of the lathe during the peeling of a single block, either when the trash gate is closed or during the cutting operation of the clipper knife. This results in a substantial savings of time and productivity, including preventing the loss of the typical 2 ½ wraps or so of veneer which occurs at each restart of the lathe. When the block is peeled down to a small diameter, i.e. 3–5 inches, the lathe is stopped and the block 25 replaced with a new block.

Figure 5:
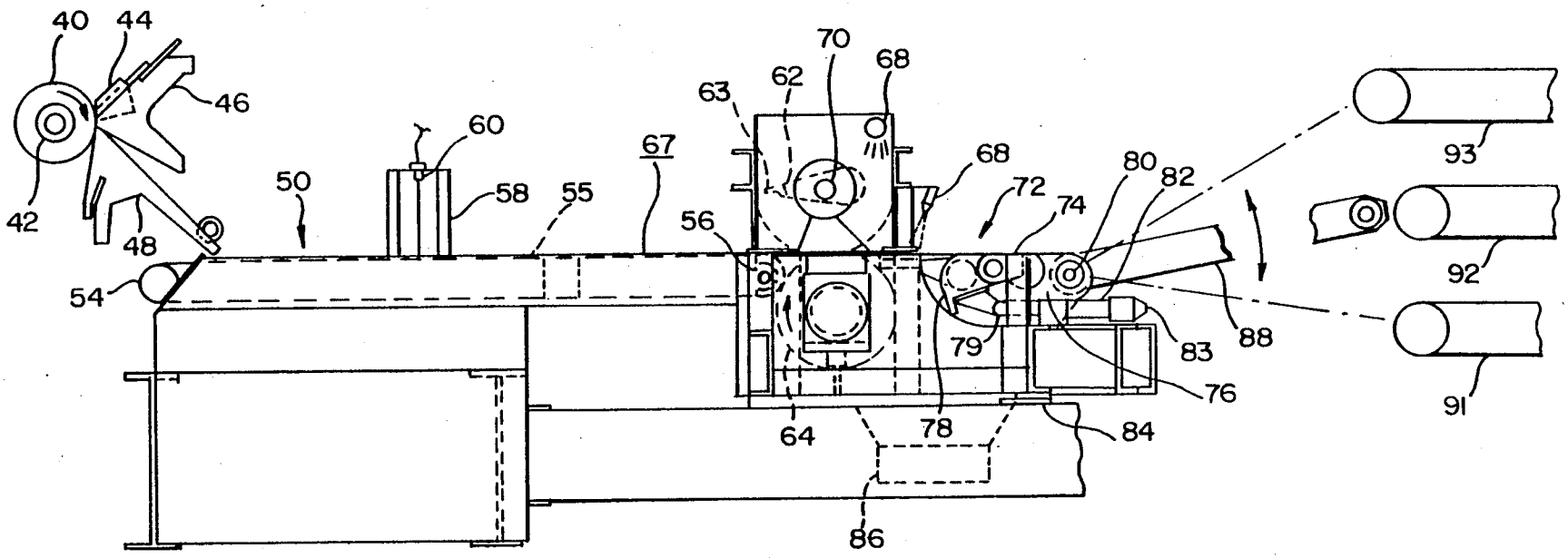
FIG. 5 is a side elevational view of the apparatus of the present invention.

FIG. 5 shows the apparatus of the present invention in more detail. The block 40 is shown as being supported on a veneer lathe spindle 42 and is rotated clockwise in operation. The lathe knife 44 is positioned adjacent the block 40 on a knife carriage structure 46 which tends to move the knife in a controlled manner gradually continuously inwardly to accomplish the peel. Positioned below the knife carriage 46 is a veneer chute 48 which angles downwardly to a horizontal apron 50. The veneer material produced by operation of the lathe moves down the veneer chute 48 to apron 50. In the embodiment shown, the apron 50 is approximately 10 feet long and 9 feet wide. It comprises a conventional conveyor belt 55 which is supported by two end rollers 54 and 56. The apron 50 typically runs at a speed of approximately 500–1000 feet per minute (fpm) during normal operation.

Approximately at the longitudinal midpoint of apron 50 is located a mounting structure 58, which is positioned above the apron 50 and across its entire width. Positioned within the mounting structure 58 and directed downwardly toward the upper surface 67 of the apron 50 are a plurality of sensors 60—60. In the embodiment shown, there are eight individual sensors regularly spaced across the width of the apron 50 in mounting structure 58; fewer or more sensors could be used, however.

Figure 3:
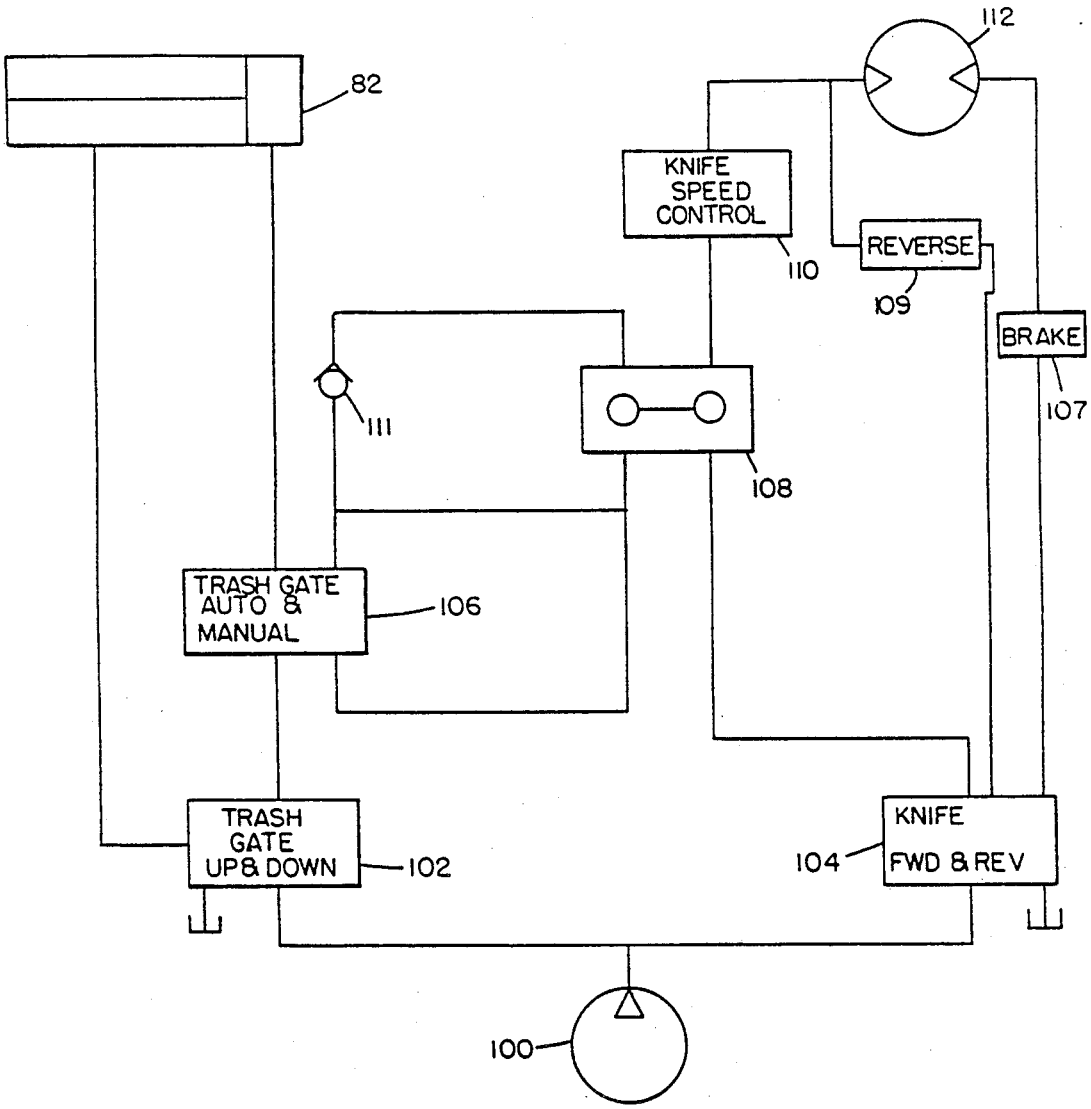
FIG. 3 is a block diagram of the hydraulic control system of the present invention.

The information from sensors 60 is applied to a control unit (not shown in FIG. 5). The control unit controls the operation of the downstream portion of the apparatus of FIG. 3, namely, the synchronous rotary clipper knife 62, the anvil roller 64, the trash gate 72 and the trash discharge air jets 68. The control unit circuitry will typically be implemented in software, but may also be in the form of conventional hardware, and provides the correct timing for the operation of the above elements in the specific sequence described hereinafter. The software code and/or the actual implementation of required hardware, including any required electronic circuitry, is routine and may be conveniently produced by one skilled in the art without undue effort, once the desired sequence of operations of the various elements is specified, as set forth below.

The veneer material produced by the lathe moves at a high rate of speed (500–1000 fpm) on the apron 50 beneath the sensors 60 to the combination of the rotary clipper 62 and the anvil roller 64. In the embodiment shown, anvil roller 64 is a rubber coated roller approximately 16" in diameter. It is positioned and mounted for rotation such that the uppermost surface point 65 is in the same horizontal plane as the upper surface 67 of apron 50. The downstream end of apron 50 terminates in the immediate vicinity of the surface of roller 64. Hence, since roller 64 is substantially adjacent the end of the apron 50, the veneer material moves directly onto the top of the roller 64.

Roller 64 is mounted so that it rotates in a clockwise direction, and is chain driven off the same driveshaft which drives apron 50, so that the rotational movement of the roller is synchronous with the speed of the apron, and hence the veneer material as well. Alternatively, the roller could be driven separately at a fixed speed. As will be discussed hereinafter, the roller speed, i.e. the rotational speed of the surface of the roller, is matched by the rotational speed of the clipper knife, i.e. the knife speed is synchronized with the roller speed. In the embodiment shown, the roller 64 typically will rotate at 120–240 RPM.

The clipper knife 62 is positioned directly above roller 64. Clipper knife 62 is mounted on a horizontal spindle 70 and extends the entire width of the veneer apparatus, as does roller 64. The shape and size of the clipper knife is conventional. In the embodiment shown, the knife is 10 inches long and 4 inches wide at its widest spot. The knife tapers to a sharp point at its outboard end 63. The speed of the outboard end, i.e. tip, of the knife is synchronous with that of the speed of the roller during the time of actual clipping of the veneer material. The clipper knife 62 is mounted so that when the knife is pointed directly downward, the tip 63 of the knife 62 rests just against or is immediately adjacent to the uppermost surface point 65 of the anvil roller 64.

Figure 4:
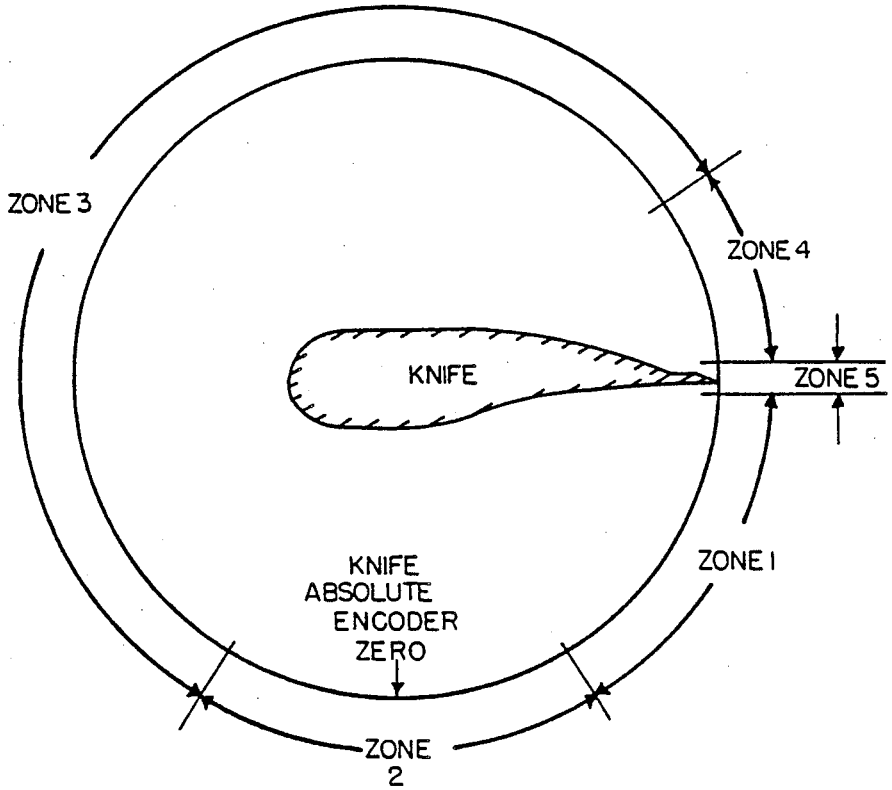
FIG. 4 is a diagram showing the change in speed of the clipper knife portion of the present invention during one revolution thereof.

The speed of the knife 62 during one revolution thereof varies depending upon the angular position of the knife. The speed of the knife is hydraulically controlled, as explained in more detail below. FIG. 4 shows the change in speed of the knife during one revolution. FIG. 4 is for clockwise rotation of the knife, which means that it (the knife) is viewed from the opposite side of the apparatus as is the view of FIG. 3, such that the knife 62 is rotating forwardly as it approaches and then passes the uppermost point of the roller 64.

In zone one, the speed of the knife increases from zero until it reaches zone 2, referred to as the air jet zone, where it is moving at approximately roller speed, equivalent to veneer speed, i.e. 500–1000 fpm. This zone is relatively small, approximately 100 counts from a total of 3900 encoder counts for one revolution. Zone 2 is shown to be substantially larger in FIG. 4 than is actually true, for purposes of illustration. The position of absolute zero for the encoder is shown in FIG. 4 as directly downward, i.e. the 6 o'clock position. When the knife passes through zone 2, it clips the veneer. Following the end of zone 2, the speed of the knife is gradually decreased in zone 3 until the knife reaches zone 4, referred to as the creep zone, in which the knife speed is quite slow, i.e. 100 ft/min. Zone 5, which is a narrow zone, is the stop zone, in which the knife is not moving. The location of this zone is accurately controlled by the hydraulic valve system within approximately ±50 counts. The cycle then begins again.

Referring now again to FIG. 5, positioned downstream of the anvil roller/clipper knife combination is the trash gate 72. The construction and arrangement of the trash gate 72 is conventional. It includes a top plate 74 which extends the full width of the apparatus and extends from a front end which is close to the surface of the anvil roller 64 a distance of approximately 3 feet to the downstream end thereof. In the embodiment shown, approximately "5" separates the veneer clipping point and the front end of the trash gate. The top plate 74 could also include a moving, i.e. "live", belt to move the veneer material along.

The trash gate further includes two sides 76—76 which extend downwardly from the plate 74 on opposite sides thereof An actuator arm 78 is attached to the undersurface of top plate 74, and initially extends forwardly and slightly downwardly and then directly rearwardly, i.e. downstream from the trash gate. The gate 72 is mounted for rotation about a horizontal axis 80. Extending rearwardly from the end 79 of actuator arm 78 is a hydraulic cylinder 82, which controls the movement of the trash gate. The base 83 of the hydraulic cylinder is attached to the frame 84 of the apparatus. In operation, the trash gate 72 rotates through an angle of approximately 45° from the horizontal about axis 80.

Positioned below trash gate 72 is a conventional trash conveyor 86, which runs the width of the apparatus and carries the veneer trash away from the apparatus to a chipper facility or the like.

Positioned just downstream of the clipper knife above the upstream end of the trash gate 72 and above the flow of the material moving past the clipper knife is a discharge jet member 68 which extends the width of the apparatus. Member 68 is a pipe which has a number of downwardly directed openings therein through which air under pressure is discharged against the horizontal flow of the veneer material. The discharge jet member 68 is operative when the trash gate is open, assisting the movement of veneer trash downwardly onto the conveyor 86. The air discharge continues until approximately the time of the clipping action which separates the veneer trash from the rest of the veneer. When the trash gate closes, the discharge jets cease operation. Thus, the air jet is operative for a relative short time (zone 2 in FIG. 4, i.e. 100 counts).

Extending downstream of the trash gate 72 is a tipple 88, shown in FIG. 5 in midposition relative to three trays 91, 92, 93. The tipple 88 is a conveyor which is rotatable about axis 80 at the downstream end of the trash gate 72. In the embodiment shown, tipple 88 connects to a selected one of three possible veneer trays 91, 92 and 93. Each tray furthermore is in the form of a conveyor which receives the veneer sheets for eventual cutting, trimming and drying. It should be understood that there could be other arrangements of primary as well as secondary tipples, and other veneer tray arrangements.

In the operation of the above described veneer system, in addition to the lathe operation, there are specific functions of the apparatus which are controlled by a hydraulic system, including specifically the clipper knife rotation and the closing and opening of the trash gate. The hydraulic system is shown in block diagram form in FIG. 3. The source of power providing the hydraulic pressure and flow is a hydraulic power unit 100. The hydraulic pressure is applied through solenoid directional control valves 102 and 104, which control, respectively, the direction of trash gate travel (open/close) and the direction of clipper knife travel. The trash gate auto and manual control valve 106 selects between automatic and manual operation. In automatic, the trash gate is operated synchronously with the movement of the clipper knife, while in the manual mode, the trash gate 72 is not necessarily synchronous in operation with the clipper knife. The hydraulic motor 100 is directly coupled to the knife motor 112.

A flow divider valve 108 provides the appropriate timing between the operation of the clipper knife and the trash gate, while knife speed control valve 110 in combination with a pressure reducing valve (not specifically shown in FIG. 3) matches the speed of the clipper knife to the roller speed and hence to the speed of the veneer movement through the apparatus. The operation of the hydraulic system is implemented in the embodiment shown by conventional hydraulic valves. However, the timing between the clipper knife and the trash gate could also be accomplished with hydraulic electro-servo valves.

Initially, the trash gate 72 is opened. Valves 102, 104 and 106 then are energized. The gate 72 will then start to close and the knife will begin rotation. The brake valve 107 will open as soon as hydraulic pressure is applied to the motor 112. The speed of the clipper knife motor 112 will increase until the pressure at solenoid valve 110 reaches a preset pressure of the pressure reducing valve, at which point the cutter knife reaches its maximum speed. The pressure reducing valve will then throttle to maintain that selected speed for a selected time, which is relatively short, as described above. The pressure reducing valve is vented to the downstream side of valve 110, so that a differential pressure is maintained across valve 110 at the preset value. After the motor 112 has attained the preset speed, fluid will recirculate through check valve 111, allowing the motor 112 to continue at the set speed until a slow down signal occurs.

The speed of the cutter knife motor 112 will thereafter be gradually reduced until the knife reaches its stop position (zone 5), where the control valve 104 is de-energized. The slow-down of the motor is accomplished following the slow-down signal by closing valve 110 at a predetermined rate to attain the knife creep speed. At the end of the creep zone (zone 4), the knife is stopped. When the knife is to operate alone, valve 104 is energized to initiate rotation. Then valve 110, in combination with its associated pressure reducing valve, is used to control the knife speed while valve 107 provides braking pressure. The knife motor can be moved forward at very slow speed by actuating valve 104 and can be reversed through the action of valve 109 which includes a needle valve which can be set to the desired speed. The trash gate can be operated in either direction (opened or closed) by valve 102, with the speed of operation regulated by valve 106.

The operation of proportional valve 110, which regulates the knife speed, is controlled by a DC voltage. This voltage is adjustable, so that synchronization of the knife speed with the peripheral speed of the anvil roller can be achieved by experimentation. Typically, after the correct slope of the DC control voltage has been once determined, that is the signal which is applied to the valve thereafter.

Lastly, the air jet member 68 is operated synchronously with the knife and the trash gate by means of a solenoid air valve (not shown).

FIGS. *6a–6c* shows successive steps of the veneer operation. In FIG. *6a*, clipper knife 62 is shown in its clipping position while trash gate 72 is open. Veneer trash (roundup) is being clipped from the remainder of the upstream veneer material. This clipping action occurs after the start of random veneer, referred to as fish tails and strips, has been recognized by the apron scanner. The trash flows beneath the trash gate to the trash conveyor. The tipple typically is in its lowermost position, although no veneer material will flow over the tipple while the trash gate 72 is in its open position.

Figure 6A:
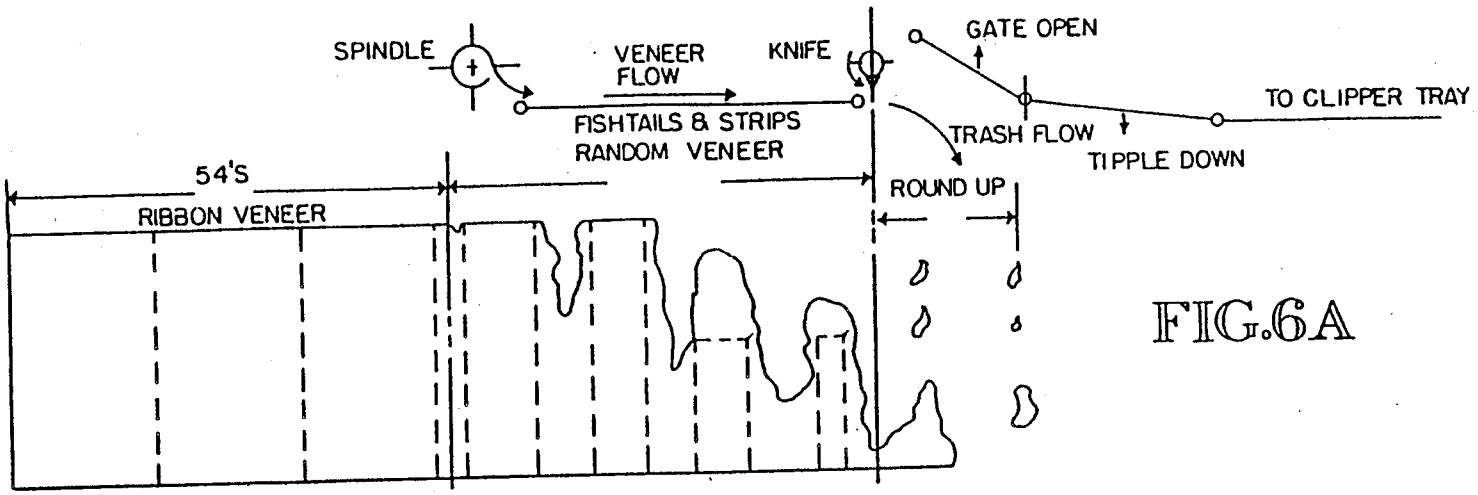
Figure 6B:
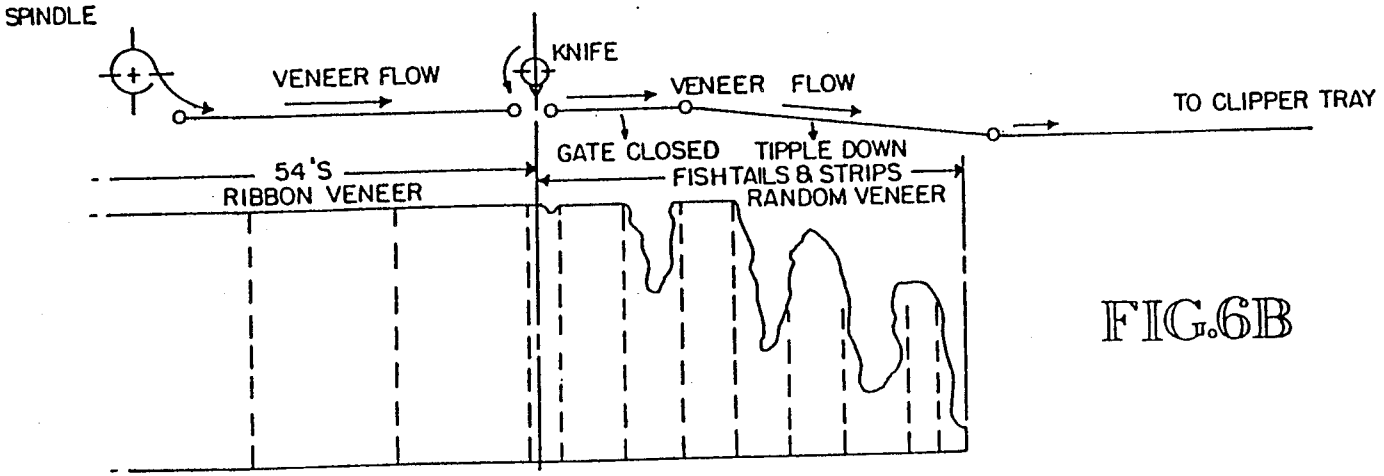

Following this first clip, the trash gate 72 closes and random veneer flows over the surface of the closed trash gate, across the tipple to the clipper tray, and from there to a station (not shown) where the random veneer is dried and cut into useable veneer strips of varying lengths and widths, as shown by the dotted lines in the random veneer portion in FIGS. 6*a* and 6*b*.

Figure 6C:
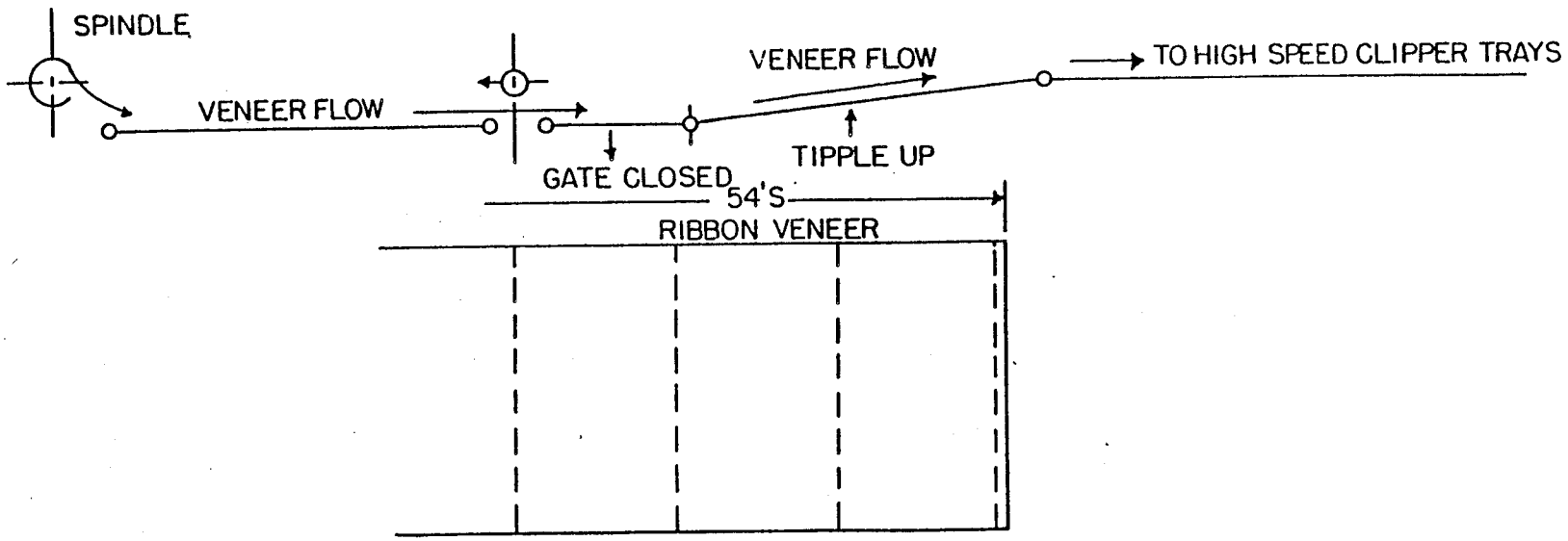

The apron scanner next recognizes the start of ribbon veneer. FIG. 6*b* shows the knife 62 in position to accomplish another clip, separating the random veneer from the follow-on ribbon veneer. Ribbon veneer is full length (101–106 inch) sections of veneer. The conventional 54 inch widths are shown by dotted lines in FIGS. 6*b* and 6*c*, even though the ribbon veneer produced from the spindle and moved onto the clipper tray (FIG. 6*c*) is continuous. In FIG. 6*c*, the trash gate remains closed and the tipple is moved up so that the continuous ribbon veneer goes to other selected clipper trays. The ribbon veneer is then dried, trimmed, cut to proper width (54 inches) and stacked. The production of ribbon veneer is continuous until the end of the block is reached, at which point the lathe is stopped, and a new block inserted. The process then begins over, with the trash gate open and the cutter knife in a stop position Peeling of the block to produce roundup then begins again.

The advantage of the present invention is that it permits the veneer lathe to operate continuously during the peeling of one block, thereby improving productivity (time savings) and product recovery. It has been demonstrated that product recovery is improved by at least 4% over conventional methods, and that productivity is improved approximately 7.5%.

Although a preferred embodiment of the invention has been disclosed herein for purposes of illustration, it should be understood that various changes, modifications and substitutions may be incorporated in such embodiment without departing from the spirit of the invention as defined by the claims which follow.

I claim:

1. A system for producing veneer, comprising:

lathe means for peeling veneer from a log, initially producing trash veneer;

means for recognizing the start of usable veneer;

cutter means for separating trash veneer from the usable veneer while the lathe means if peeling veneer;

trash gate means located in the downstream vicinity of the cutter means, said trash gate means having an open position and a closed position, wherein in the open position, trash veneer is directed therebeneath to a trash receiver or the like; and means for closing the trash gate at approximately the time that the separating means operates to separate the trash veneer from the usable veneer, such that when the trash gate is closed, usable veneer moves over the trash gate to a veneer tray for further processing, the trash gate being positioned relative to the separating means and operated relative to the separating means such that the lathe can operate continuously without interruption to accomplish complete peeling of the log.

2. An apparatus of claim 1, including a roller located beneath the separating means which is configured and arranged such that the separating means and the roller cooperate to result in the separating of the trash veneer from the usable veneer, the apparatus further including means for rotating the roller such that the speed of said roller is approximately equal to the speed of veneer material as it is moved from the lathe means to the separating means.

3. An apparatus of claim 2, including an apron conveyor which receives the veneer material from the lathe and moves it to the separating means.

4. An apparatus of claim 3, wherein the separating means moves at a speed of rotation and wherein the apparatus includes means for controlling the speed of rotation of the separating means such that said speed varies over one full rotation thereof, the speed of rotation of the separating means at the time when it separates the veneer trash from the usable veneer being approximately the same as the rotation speed of the peripheral surface of the roller.

5. An apparatus of claim 4, wherein said speed control means controls the speed of rotation of the separating means following the separating of the trash veneer from the usable veneer such that said speed decreases over a substantial angular portion of one rotation of the separating means to a selected point where the separating means stops momentarily, awaiting a new cycle of rotation to be initiated.

6. An apparatus of claim 1, wherein the trash gate is positioned immediately downstream of the separating means.

7. An apparatus of claim 2, including means for controlling the speed of rotation of the separating means relative to the speed of the roller such that upon separation of the trash veneer from the usable veneer, the leading edge of the usable veneer tends to lift up, tending to follow the movement of the separating means, over the top of the closed trash gate.

8. An apparatus of claim 1, including means for recognizing the start of ribbon veneer following recognition of the start of usable veneer, wherein the separating means is controlled to cut the usable veneer approximately in the vicinity of the start of ribbon veneer.

9. An apparatus of claim 1, including means directing the usable veneer after it has passed over the trash gate to a selected veneer tray.

10. An apparatus of claim 2, including means producing a flow of air directed downwardly in the area immediately downstream of the separating means during the time that the trash gate is open, tending to force the veneer trash beneath the trash gate to the veneer trash receiver.

11. A veneer clipper and trash gate system for use in a veneer producing apparatus which includes a lathe for peeling veneer from a log and means for recognizing the start of usable veneer from preceding trash veneer, comprising:

a clipper for cutting the veneer produced by the lathe to separate usable veneer from the preceding trash veneer, while the lathe is peeling veneer;

trash gate means located immediately downstream of said clipper means, said trash gate means having an open position and a closed position, wherein in the open position, the trash veneer is directed therethrough to a trash receiver; and means for controlling the position of the trash gate means such that when the lathe begins to peel a log, producing trash veneer, the trash gate is open and such that when the clipping means is cutting the trash veneer from the upstream usable veneer the trash gate is sufficiently closed that the usable veneer moves over the trash gate, permitting the lathe to peel the log without stopping.

12. An apparatus of claim 11, including a roller located beneath the clipper which is configured and arranged such that the clipper and the roller cooperate to separate the trash veneer from the usable veneer, the apparatus further comprising means for synchronizing the speed of the roller with the speed with the veneer material as it is moved from the lathe to the clipper and the speed of the clipper during cutting of the veneer.

13. An apparatus of claim 11, including means mounted above the trash gate for generating and directing a burst of air downwardly in the area immediately downstream of the clipper during the time that the trash gate is open, tending to force veneer trash beneath the trash gate to the veneer trash receiver.

* * * * *